US005599011A

United States Patent [19]

Schnorr et al.

[11] Patent Number: 5,599,011

[45] Date of Patent: Feb. 4, 1997

[54] SHEET FEEDER

[75] Inventors: Richard E. Schnorr, Riverside; Marland R. Johnson, Orland Hills, both of Ill.

[73] Assignee: Uarco Incorporated, Barrington, Ill.

[21] Appl. No.: 338,334

[22] Filed: Nov. 14, 1994

Related U.S. Application Data

[63] Continuation-in-part of Ser. No. 97,846, Jul. 26, 1993, abandoned.

[51] Int. Cl.[6] ..... B65H 5/00

[52] U.S. Cl. ..... 271/10.11; 271/110; 271/125

[58] Field of Search ..... 271/10.11, 110, 271/121, 124, 125, 258.01, 262, 263, 104, 137, 138, 167, 10.03, 10.02

[56] References Cited

U.S. PATENT DOCUMENTS

| | | | |
|---|---|---|---|
| 1,515,986 | 11/1924 | Wright et al. | 271/125 |
| 1,646,883 | 10/1927 | Sheldrick . | |
| 1,682,578 | 8/1928 | Nipchild . | |
| 1,866,847 | 7/1932 | Finfrock . | |
| 1,955,066 | 4/1934 | Hiller . | |
| 3,239,213 | 3/1966 | Griswold . | |
| 3,771,783 | 11/1973 | McIneray | 271/125 |
| 3,933,350 | 1/1976 | Mignano | 271/125 |
| 3,970,298 | 7/1976 | Irvine et al. | 271/122 X |
| 3,991,998 | 11/1976 | Banz et al. | 271/125 |
| 4,183,662 | 1/1980 | Bloemendaal et al. . | |
| 4,232,860 | 11/1980 | Brown | 271/125 X |
| 4,284,269 | 8/1981 | Ignatjev | 271/122 |
| 4,306,713 | 12/1981 | Auritt et al. | 271/122 X |
| 4,397,456 | 8/1983 | Eberle . | |
| 4,437,658 | 3/1984 | Olson | 271/125 |
| 4,443,006 | 4/1984 | Hasegawa | 271/124 X |
| 4,479,597 | 10/1984 | Johnson et al. . | |
| 4,603,848 | 8/1986 | Markgraf et al. | 271/125 |
| 4,718,809 | 1/1988 | Krasuski et al. | 271/125 X |
| 4,844,435 | 1/1989 | Giannetti et al. . | |
| 4,991,830 | 2/1991 | Yamanaka | 271/127 X |
| 4,991,831 | 2/1991 | Green | 271/125 X |
| 5,083,766 | 1/1992 | Osawa | 271/126 X |
| 5,105,078 | 4/1992 | Nochise et al. . | |
| 5,172,145 | 12/1992 | Stephenson . | |

*Primary Examiner*—David H. Bollinger
*Attorney, Agent, or Firm*—Wood, Phillips, VanSanten, Clark & Mortimer

[57] ABSTRACT

A sheet feeder (10) includes a frame (26) with an inclined surface (94) for supporting a stack of sheets to be fed and a feed roller (96) mounted on the frame (26). A retard roller (106) is mounted adjacent to the feed roller (96) and cooperates therewith to define a nip (108) for receiving a forward edge of the bottom sheet in the stack. Upright guides (116, 119) are mounted on the frame (26) and are engageable with a forward edge of a stack of sheets supported on the inclined surface (94). The guides (116, 119) are disposed at an acute angle with respect to the inclined surface (94) so that when the forward edge of the stack engages the guides (116, 119) the sheets automatically shift longitudinally relative to each other to facilitate feeding of a single sheet into the nip (108).

36 Claims, 7 Drawing Sheets

SHEET FEEDER

CROSS REFERENCE

This application is a continuation-in-part of our application Ser. No. 08/097,846 filed Jul. 26, 1993 and entitled "SHEET FEEDER", now abandoned.

BACKGROUND OF THE INVENTION

1. Technical Field

This invention is a machine for feeding sheets of paper, and more particularly is a machine for feeding single sheets of paper from the bottom of a generally upright stack of sheets.

2. Background Art

A bottom sheet feeder is used to release a sheet from the bottom of a stack of sheets and to feed a released sheet toward form handling or form processing equipment. The cycle of releasing and feeding sheets is repeated continuously so that newly exposed bottom sheets are consecutively released from the stack and fed seriatim toward a processing line.

Friction-type bottom sheet feeders have a powered roller upon which a stack of sheets is placed. The weight of the stack bears against the roller to produce a friction force between the bottom sheet and the roller. When the roller is rotated the roller frictionally grasps the bottom sheet and releases the sheet from the stack. As the roller continues to rotate the bottom sheet is drawn from the stack and is advanced toward additional sheet feeding components. An adjacent sheet is exposed to the roller and the cycle continues until the supply of sheets in the stack is depleted.

The problem with present friction-type bottom sheet feeders is that the weight of a stack of sheets produces friction not only between the bottom sheet and the underlying roller, but also between each pair of adjacent sheets in the stack (with a relatively large friction force acting between adjacent sheets near the bottom of the stack because of the weight thereof). When the weight of the stack is large, for instance, when the number of sheets in the stack exceeds about 250 sheets, or when the sheets have interior perforations to facilitate subsequent tearing, the bottom sheet becomes frictionally engaged with one or more overlying sheets and the roller frequently feeds two or more sheets from the stack (referred to in the industry as "doubling") toward the processing line. Doubling causes jamming of equipment and necessitates costly shutdowns to clear a jam and resume processing. Doubling also reduces the smooth flow of sheets toward a processing line and limits the rate at which sheets are fed. Alternatively, the machine may not feed at all, known in the industry as "stalling".

One solution to the problem of doubling or stalling is to limit the size of the stack of sheets positioned on the roller. By using a smaller stack the weight of the stack and thus the magnitude of the friction force between adjacent plies is reduced and the likelihood of doubling or stalling is reduced. Machines which are limited to using a relatively short stack require constant monitoring and reloading to maintain a high feed rate, such as several thousand sheets per hour. Consequently, prior sheet feeders require extensive operator intervention merely to avoid the feeding of double sheets, thereby incurring additional time and labor cost in the sheet handling process.

The present invention is directed toward overcoming one or more of the above problems.

SUMMARY OF THE INVENTION

It is a principal object of the invention to provide a new and improved bottom sheet feeder. More specifically, it an object of the invention to provide such a sheet feeder that is capable of reliably feeding sheets from the bottom of a stack which contains five hundred or more sheets without doubling and/or stalling.

An exemplary embodiment of the invention achieves the foregoing object in a sheet feeder including a frame with an inclined surface for supporting a stack of sheets to be fed and a feed roller mounted on the frame. A retard roller is mounted adjacent to the feed roller and cooperates therewith to define a nip for receiving a forward edge of the bottom sheet in the stack. An upright guide is mounted on the frame and is engageable with a forward edge of a stack of sheets supported on the inclined surface. The guide is disposed at an acute angle with respect to the inclined surface so that when the forward edge of the stack engages the guide the sheets automatically shift longitudinally relative to each other to facilitate feeding of a single sheet into the nip.

In the highly preferred embodiment, the surface of the feed roller is relatively soft while the surface of the retard roller is relatively hard. Further, retard roller and feed roller are arranged to be in at least touching relation. Preferably, the retard roller is located so as to slightly deform the periphery of the feed roller at the point of contact between the two. That is to say, the arrangement is such that the retard roller touches or enters the cylindrical periphery of the undeformed, softer feed roller.

The guide preferably is disposed at an angle relative to the inclined surface in the range of from about 60 degrees to about 80 degrees and has a polished surface for engaging the forward edge of a stack of sheets. In a highly preferred embodiment the guide has a chrome plated surface.

According to one facet of the invention, the retard roller has an exposed surface which extends beyond the guide so that the forward edge of a bottom one of the sheets in the stack contacts the exposed surface before being received in the nip to facilitate the transition of a sheet from the stack into the nip. In addition, the guide has a straight upper end and a curved lower end so that sheets engaged with the bottom end of the guide shift relative to each other a distance greater than sheets engaged with the upper end of the guide.

The invention contemplates that the retard roller is offset downstream from a top dead center position of the retard roller with respect to the underlying feed roller. In the preferred form of the invention, a line connecting the center of the feed roller and the center of the retard roller is inclined relative to the top dead center position of the retard roller at an angle in the range of from about 5° ahead to about 2° behind top dead center, with a preferred position of 0° 30' past top dead center. Offsetting the retard roller from the top dead center position facilitates paper control of a single sheet out of a nip between the retard roller and the feed roller.

According to another facet of the invention, the sheet feeder has an urge roller which is engageable with a bottom sheet on the stack for advancing the sheet toward the feed roller, the urge roller and the feed roller having diameters which are substantially equal. The urge roller and the feed roller preferably are coated with rubber and the retard roller is coated with urethane having a durometer in the range of from about 50 to about 70 on the Shore A scale of relative hardness.

A preferred rubber coating for the urge and feed rollers is a soft natural rubber provided with a medium or rough crepe finish.

When the sheet feeder is to be used in conjunction with a downstream component having a roller for drawing sheets from the feed roller on the sheet feeder, the ratio of the rate of rotation of the feed roller to the rate of rotation of the downstream roller is prescribed in the range of from about 0.5 to about 1. Because the sheets are drawn from the feed roller by the downstream roller faster than they are drawn by the feed roller from the bottom of the stack, the amount of overlap of two consecutively fed sheets is reduced and double feeding is prevented.

The retard roller is mounted on a shaft having a shoulder at one end and a threaded opposite end. A locking plate is movable along the shaft and engageable with the shoulder. The shaft end is threadedly engaged with the frame whereby rotation of the shaft causes the shoulder to move toward the retard roller and hold the plate in frictional engagement with the retard roller to prevent the retard roller from rotating when the feed roller rotates. A fastener on the frame is received in an anti-rotation opening on the locking plate to support the locking plate when the retard roller is being installed and in conjunction with a surface to prevent the locking plate from rotating.

In a preferred embodiment of the invention, the sheet feeder is adapted to feed sheets from the bottom of a stack of generally rectangular sheets each having a width of approximately 8.5 inches and a length of approximately 11 inches. In order to reliably feed single sheets from the bottom of a stack of one thousand or more sheets, the feed roller and the urge roller have a diameter in the range of from about 2.5 inches to about 5 inches. Urge roller rotation is in the range of about 70% to about 100% of feed roller rotation with a 1:1 (100%) ratio preferred. The retard roller has a diameter in the range of from about 0.75 inches to about 3 inches. The feed roller and the urge roller extend through the inclined surface and lift the bottom sheet of the stack from about 0.0 inches to about 0.6 inches above the inclined surface to reduce friction between the surface and the bottom sheet. The center of the feed roller preferably is spaced from about 3.0 inches to about 6.0 inches from the center of the urge roller to maximize the amount of the bottom sheet which is supported out of engagement with the inclined surface.

A cover assembly substantially encloses the nip when the sheet feeder operates. A narrow opening on the cover assembly permits insertion of a single sheet into and withdrawal of a single sheet from the nip when the sheet feeder operates to measure the feed force in the nip. The opening has a sloped lip for directing a single sheet toward the nip.

A photoelectric through beam scanner is incorporated into the sheet feeder. The scanner detects if more than a single sheet has been fed, if this occurs the sheet feeder is stopped by the scanner.

As a result of the foregoing construction, high feed rates may be obtained while reliably feeding single sheets from the bottom of a stack of a thousand or more sheets. Because the sheets automatically shift relative to each other, that is, "fan out" prior to feeding, resistance between the adjacent leading edges of the stacked sheets is overcome prior to feeding and the feed/urge rollers advance only a single sheet, avoiding undesirable "doubling".

DETAILED DESCRIPTION OF THE INVENTION

Figure 1:
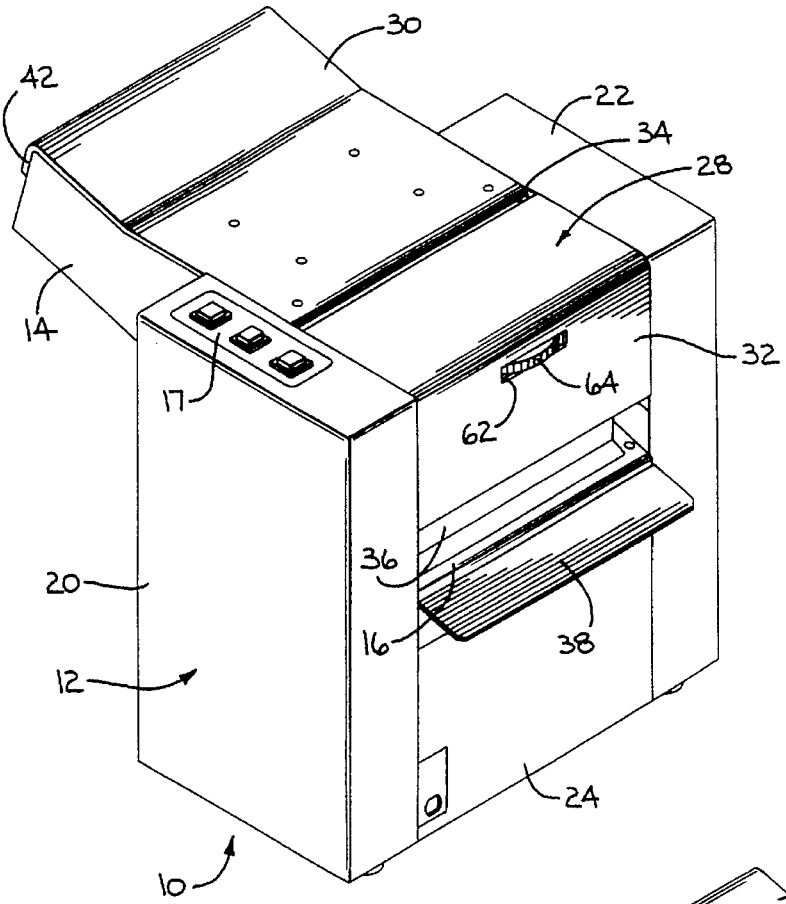
FIG. 1 is a perspective view of a sheet feeder according to the present invention.

A bottom feed sheet feeder according to the present invention is generally designated 10 in FIG. 1. The sheet feeder 10 has a housing, generally designated 12, for enclosing components suitable for drawing sheets from the bottom of a stack of sheets received in a hopper 14 and feeding the sheets seriatim through an elongate opening 16 on the rear, that is, the downstream end, of the housing 12. Operation of the sheet feeder 10 is controlled by use of a control panel 17 whereby electrical power is selectively supplied to energize the sheet feeder 10 through a power cord (not shown).

Figure 4:
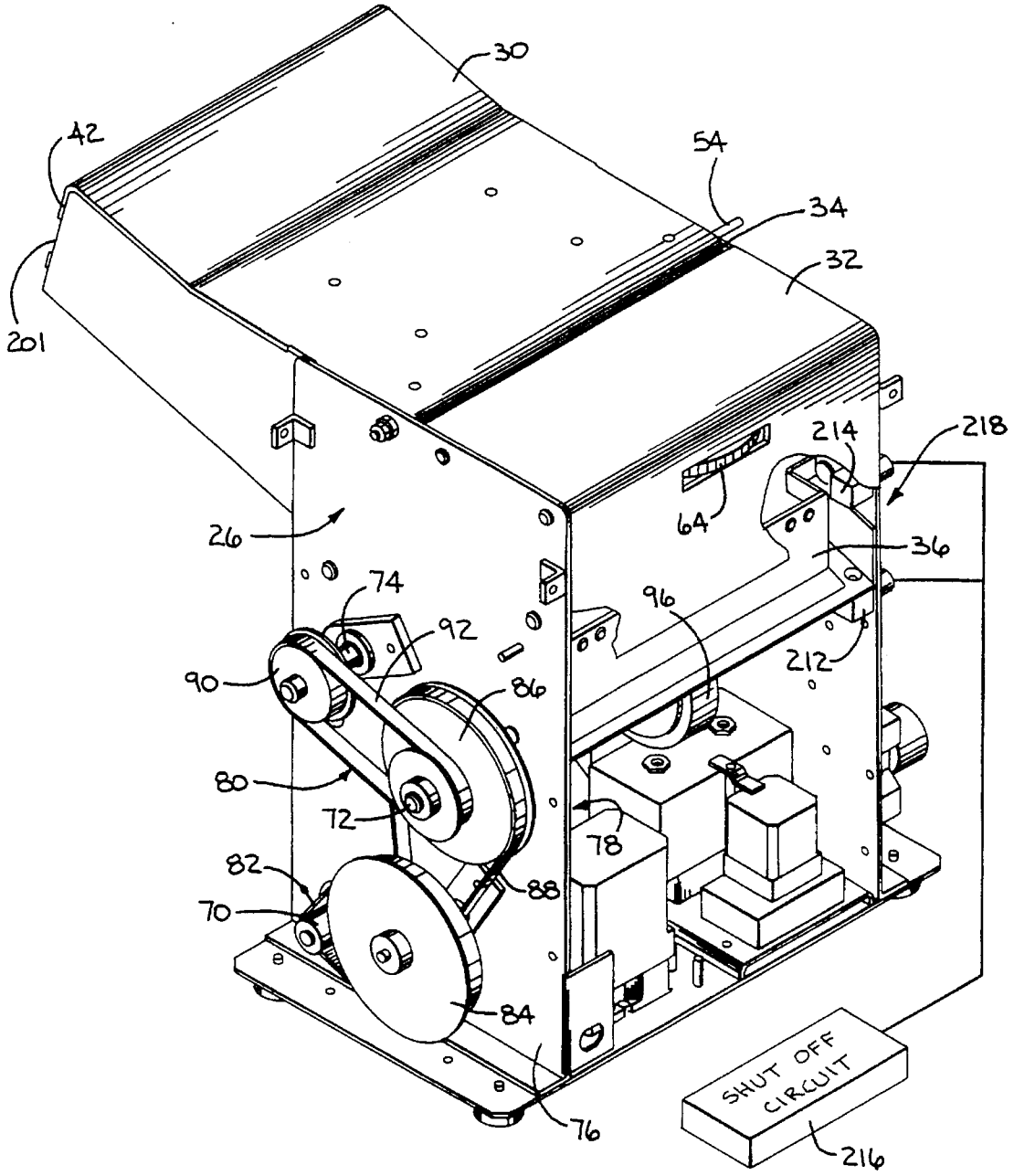
FIG. 4 is a perspective view of the sheet feeder with the side covers and outfeed cover removed.
Figure 5:
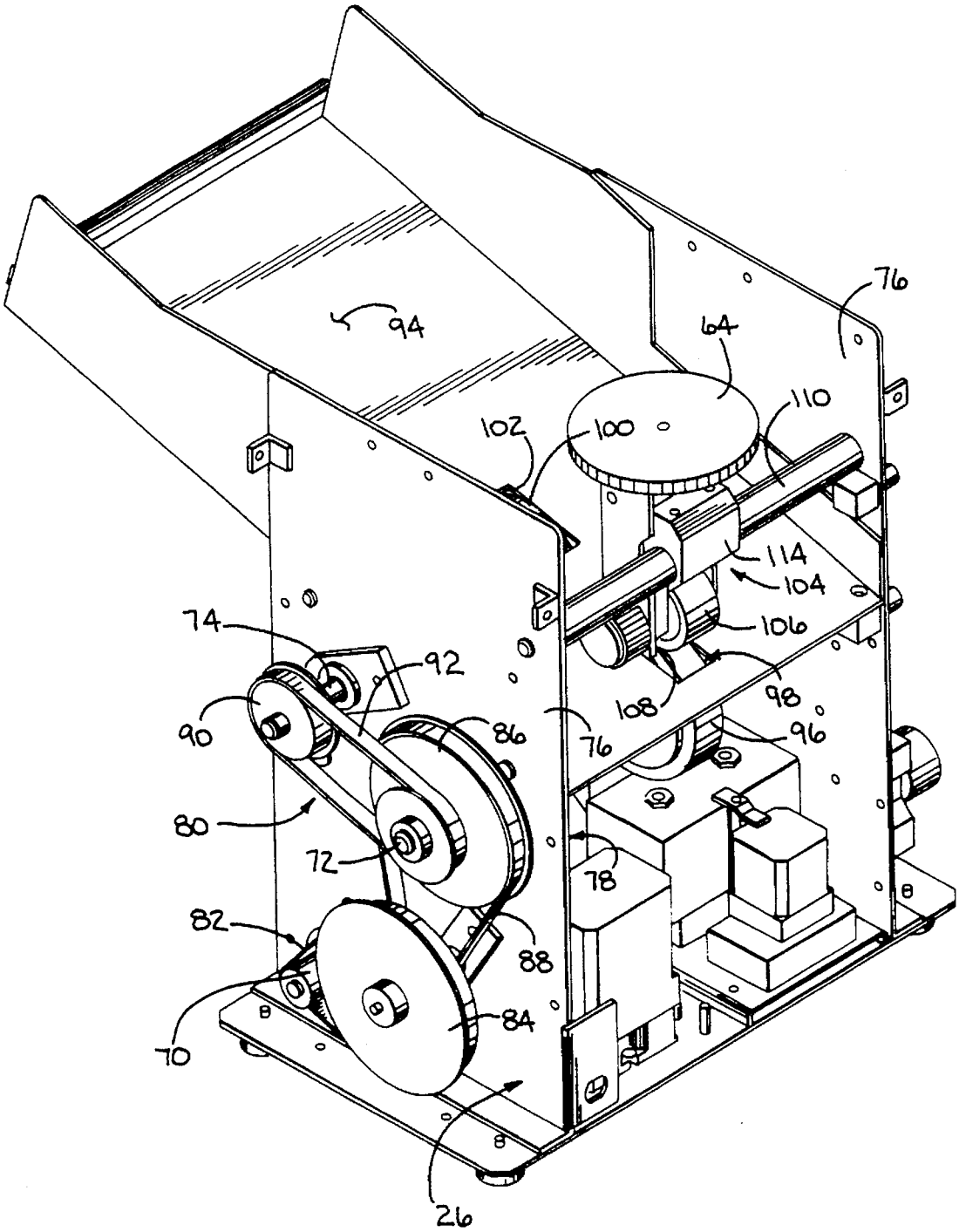
FIG. 5 is a perspective view similar to FIG. 4 with the top cover assembly and paper guide removed.
Figure 6:
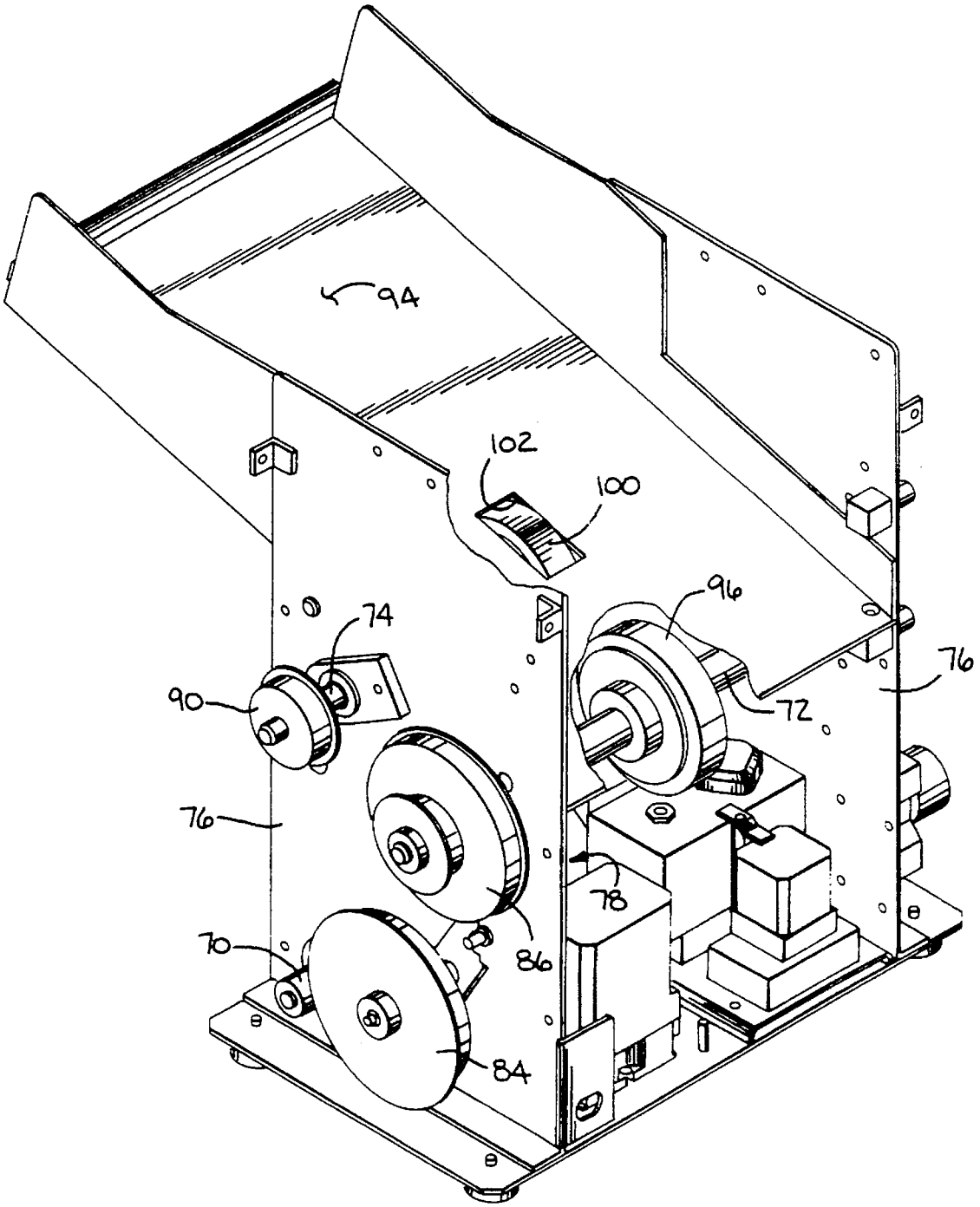
FIG. 6 is a perspective view similar to FIG. 5 with the drive belts and retard mechanism assembly removed.
Figure 9:
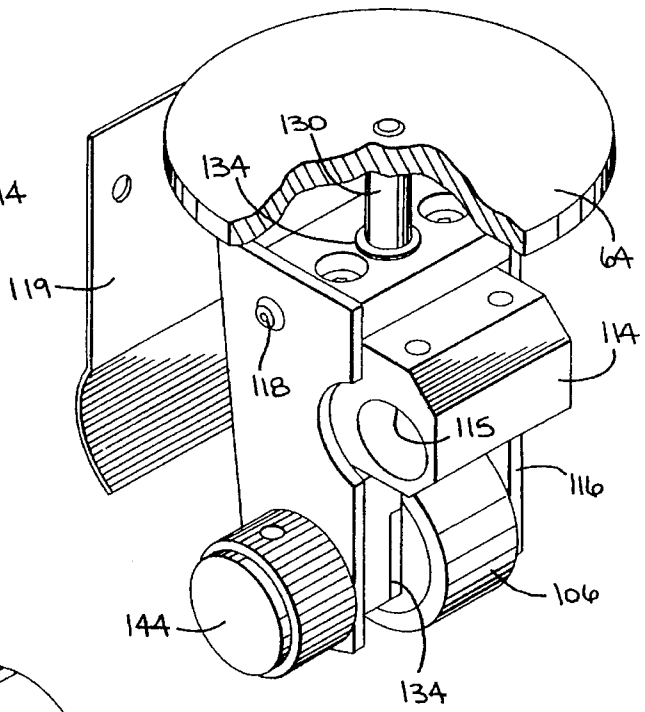
FIG. 9 is a broken away perspective view of the retard mechanism assembly.
Figure 8:
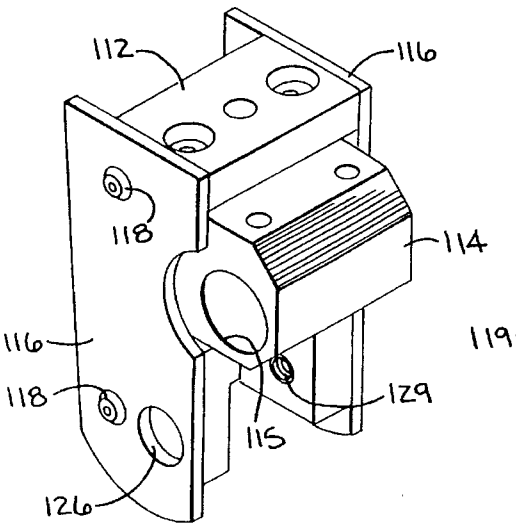
FIG. 8 is a perspective view of the mounting block with paper guide plates attached thereto.
Figure 7:
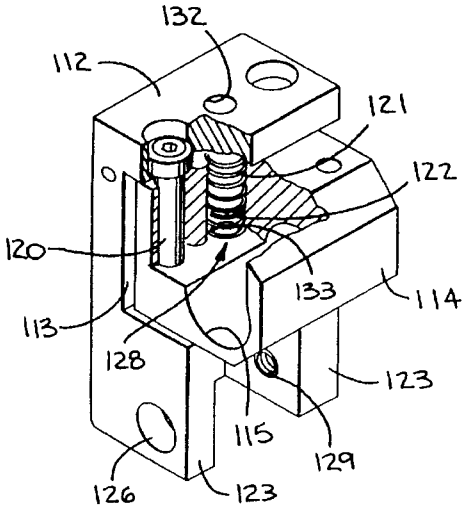
FIG. 7 is a broken away perspective view of a mounting block in the retard mechanism assembly.
Figure 10:
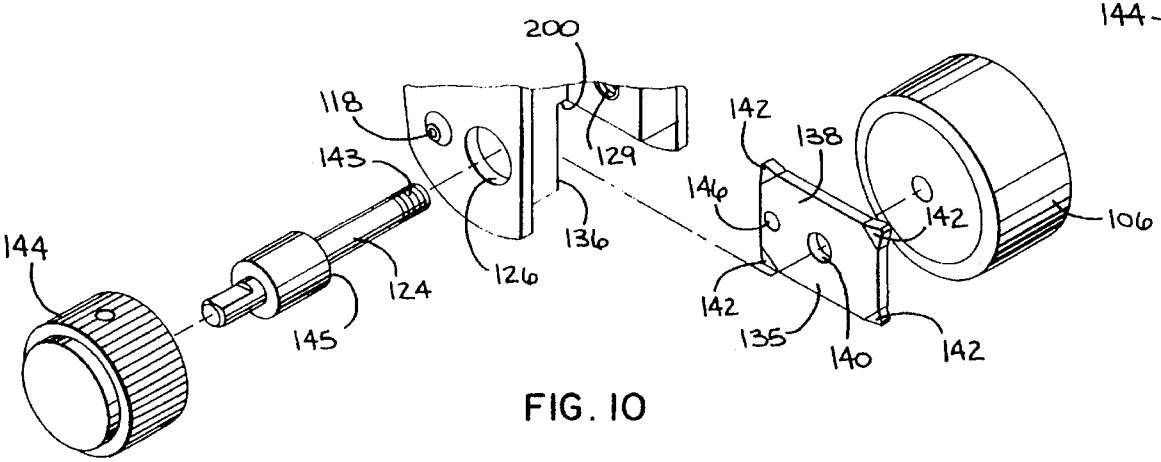
FIG. 10 is an exploded view of the friction adjustment mechanism in the retard mechanism assembly.

The housing 12 is a generally rectangular shell with a pair of laterally spaced side covers 20 and 22 and an outfeed cover 24 attached to adjacent faces of an upright frame 26 (FIGS. 4–6). The covers 20, 22 and 24 are removably mounted on the frame 26 to allow access to the sheet feeding components mounted thereon. A transparent cover assembly 28 encloses the top of the housing 12 and includes a movable cover 30 supported on the hopper 14 and a stationary cover 32 positioned along the top and rear face of the housing 12. The stationary cover 32 is spaced slightly downstream of the movable cover 30 so as to define a gap 34 on the housing 12 for providing access to the housing interior as described hereafter. A generally inverted T-shaped guide 36 (FIG. 11) is rotatably mounted in the elongate opening 16. The guide 36 can serve as a jam detector by operating a cam and switch if a sheet jams during the feed cycle. An angle bracket 38 (FIG. 1) on the outfeed cover 24 defines a lip for guiding sheets discharged from the opening 16.

Figure 2:
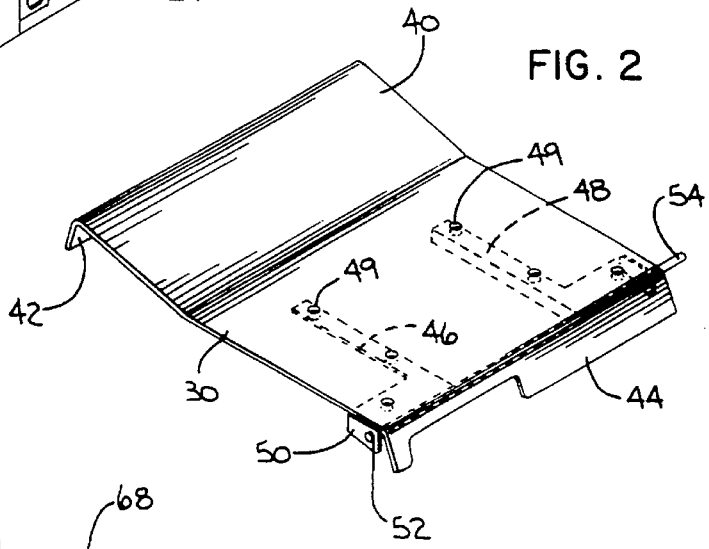
FIG. 2 is a perspective view of a movable cover on the sheet feeder.
Figure 3:
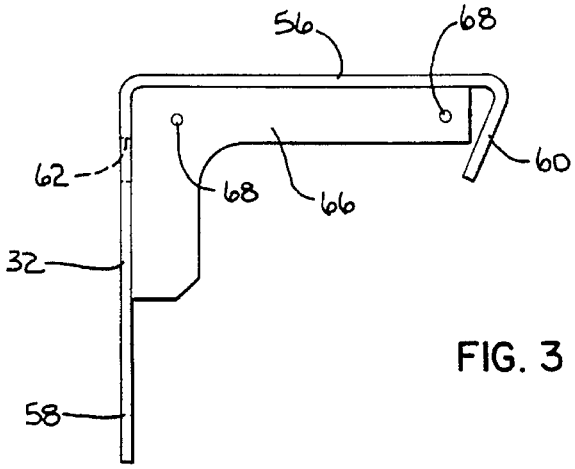
FIG. 3 is a side view of a stationary cover on the sheet feeder.

Details of the cover assembly 28 are illustrated in FIGS. 2 and 3. The movable cover 30 has an upwardly bent generally rectangular panel 40 with a downturned lip 42 at one end and a sloped lip 44 at an opposite end. Stiffeners 46 and 48 are secured to the underside of the panel 40 by fasteners 49 and serve to rigidify the movable cover 30. The stiffeners 46 and 48 each have an ear 50 with an opening 52 for receipt of an integral hinge pin 54 (FIG. 4) which extends laterally from the stiffener 48 and is mounted on the frame 26 whereby the cover 30 can be pivoted between a closed position and a raised, open position for accessing the interior of the housing 12.

The stationary cover 32 has a pair of mutually perpendicular integral panels 56 and 58. The panel 56 overlies the top of the housing 12 and has a sloped lip 60 positionable near the lip 44 on the movable cover 30 to define the gap 34. The panel 58 has an opening 62 through which the edge of an adjustment knob or hand wheel 64 (FIG. 1) extends for selective manipulation by a user. The stationary cover 32 has a pair of spaced apart mounting plates 66 with fastener receiving openings 68 for rigidly connecting the cover 32 to the frame 26.

As shown in FIGS. 4–6, wherein the sheet feeder 10 is illustrated in various stages of assembly to facilitate an understanding thereof, the sheet feeder 10 has a drive shaft 70 and a pair of driven through shafts 72 and 74 which project outwardly through one of the sidewalls 76 of the frame 26. The shaft 70 is connected to the output shaft of a conventional electric motor 78 enclosed within the housing 12 and transfers power to the shafts 72 and 74 via a belt drive system, generally designated 80.

More particularly, a belt 82 is trained around an outer end of the drive shaft 70 and drivingly engages the outer diameter of a double idler pulley 84 which is bracket mounted to the wall 76. The shaft 72 mounts a double pulley 86. A belt 88 is trained around a reduced diameter side (not shown) of the double pulley 84 and drivingly engages the large diameter of the double pulley 86. A pulley 90 is fixed to the shaft 74. A belt 92 is trained around a reduced diameter of the double pulley 86 and drivingly engages the pulley 92. As can be understood from the foregoing, actuation of the drive shaft 70 results directly in rotation of the coupled driven shafts 72 and 74. The pulleys 86 and 90 on the driven shafts 72 and 74, respectively, have diameters selected such that the ratio of the angular speed of the shaft 74 to the angular speed of the shaft 72 is in the range of approximately 70% to 100%. In the preferred form of the invention, the small diameter of the pulley 86 and the pulley 90 on the driven shafts 72 and 74, respectively, have substantially equal diameters whereby the driven shafts 72 and 74 rotate at substantially equal rates when the motor 78 is energized.

The hopper 14 has an inclined feed surface 94 for supporting sheets which are to be fed through the opening 16 in the housing 12. A feed roller 96 is fixed to the shaft 72 for rotation therewith and has part of its periphery extending through an opening 98 in the surface 94 to frictionally engage the underside of sheets supported thereon. An urge roller 100 is fixed to the shaft 74 for rotation therewith and likewise partially extends through an opening 102 in the surface 94 to frictionally engage the underside of sheets at a location upstream of the feed roller 96. A retard mechanism assembly 104 is mounted to the frame 26 and includes a stationary, that is, non-rotatable retard roller 106. The retard roller 106 is positioned adjacent the feed roller 96 and cooperates therewith to define a nip 108 (FIGS. 11–13) for receiving a sheet from the hopper 14.

Because the retard roller 106 does not rotate during operation of the mechanism, it will be appreciated that it need not be in the form of a roller. Rather, the same could be in most any configuration so long as it included an arcuate surface facing the feed roller 96 as well as the feed surface 94. Conveniently, however, the use of a roller as the retard surface 106 facilitates ready adjustment of the surface 106 as it wears and minimizes the need for replacement of the retard surface 106.

More specifically, and referring also to FIGS. 7–10, the retard mechanism assembly 104 is mounted on a transverse rod 110 extending between opposite side walls 76 of the frame 26. The assembly 104 includes a mounting block 112 having a horizontally directed notch 113, a bracket 114 secured to the rod 110 and having a bore 115 receiving the rod 110, a pair of side plates/paper guides 116 attached to opposite sides of the mounting block 112 by fasteners 118, and a paper guide 119 attached to the infeed or upstream side of the mounting block 112. The paper guide 119 nests between the side plates/guides 116 and has a lower curved end that covers the infeed side of the retard roller 106 except at the nip 108. The guide 119 serves to eliminate "fold backs" or top layer delamination of sheets or forms in the stack as they are fed. In particular, the guide 119 prevents paper sheets in the stack from contacting the retard roller 106 while the edges of the sheets are abutting the side plate/guides 116. If such contact were permitted to occur, part of the edge of the sheet contacting the retard roller 106 might remain at that particular position, spaced above feed surface 94. As the remainder of the sheets descended toward the feed surface 94 as sheets below such sheet are fed, a small fold occur will which, of course, is highly undesirable. Returning to the bracket 114, the same is loosely disposed in the notch 113 and is vertically movable therein on guides 120 (only one of which is shown). A compression spring 121 is located in a bore 122 in the mounting block bracket 114 and biases the mounting block 112 upwardly on the bracket 114 which is stationary by reason of its being secured to the rod 110. The mounting block 112 has a pair of depending spaced apart legs 123. The retard roller 106 is rotatable on a shaft 124 received in an opening 126 on one of the paper guides 116, inserted through an opening 128 in one leg 123, and engaged with a threaded opening 129 in the other leg 123.

The adjustment knob 64 has a threaded stem 130 which extends through a bore 132 in the mounting block 112, axially through the compression spring 121, and into a threaded bore 133 (FIG. 7) in the bracket 114. A washer 134 on the stem 130 engages the upper side of the mounting block 112. Manual rotation of the knob 64 causes the stem 130 to advance into or out of the bore 133 in the bracket 114 so as to lower or raise the mounting block 112 on the bracket 114. Displacement of the mounting block 112 relative to the bracket 114 thus causes the paper guides 116, 119 and the retard roller 106 to move toward or away from the feed roller 96. The retard roller 106 therefore is adjustably vertically positionable by means of the adjustment knob 64 to vary the size of the nip 108 and the corresponding friction force between the feed roller 96 and a bottom sheet in the hopper 14. Every effort should be made to eliminate play in the just described mechanism to assure reliable feeding.

The retard roller 106 preferably is coated with urethane having a durometer in the range of from about 50 to about 70 on the Shore A scale of relative hardness, with a highly preferred embodiment having a urethane coating with a durometer of 60 A. Abrasion resistance of the urethane coating promotes decreased wear of the retard roller 106 and thereby permits greater control over the size of the nip 108. The retard roller 106 has a diameter in the range of from about 0.75 to about 3 inches, and preferably has a diameter of about 1.75 inches; and a width in the range of 0.5 to about 2.0 inches. A 0.865 width is preferred.

Figure 11:
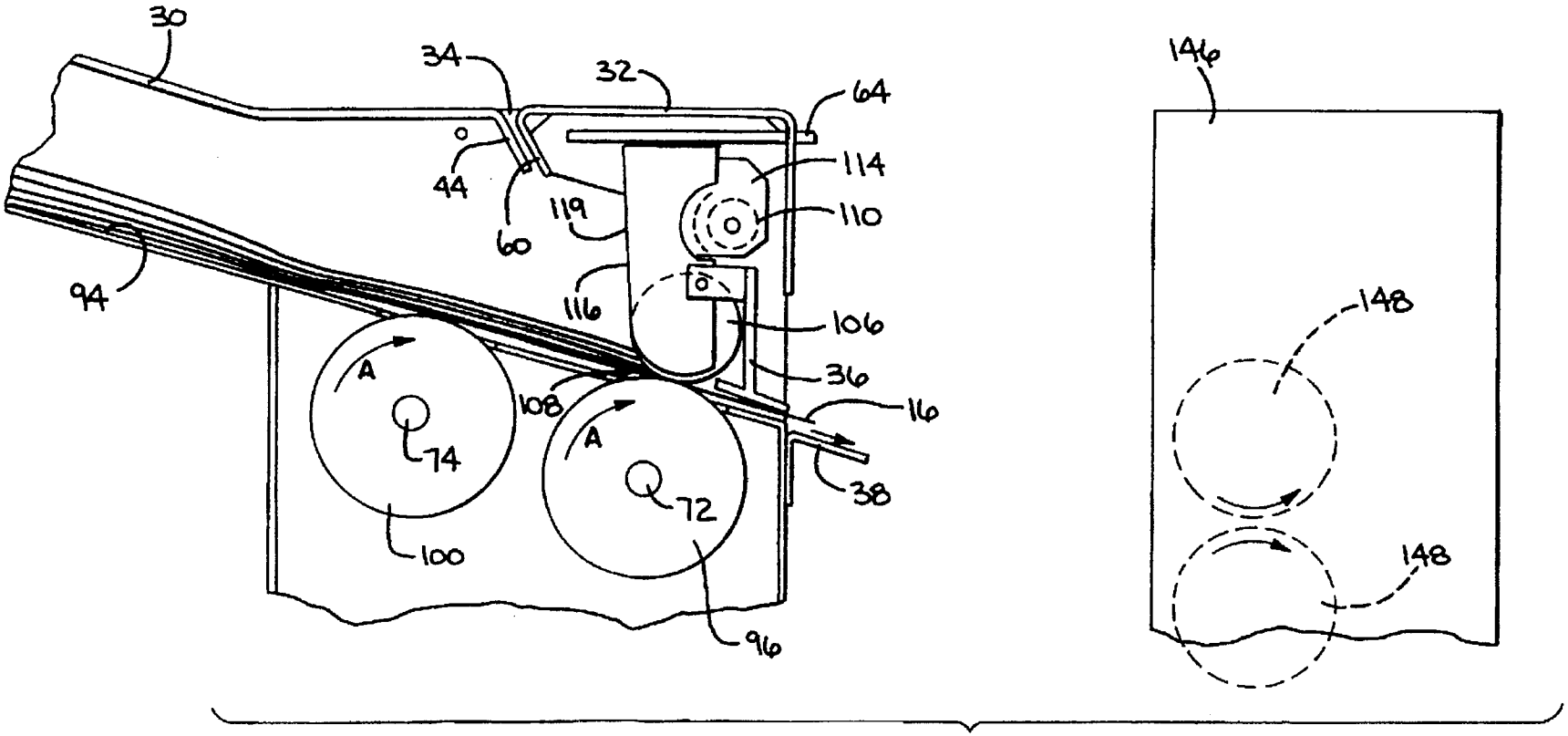
FIG. 11 is a schematic view of a roller arrangement for feeding sheets from the bottom of a stack.

As illustrated schematically in FIG. 11, actuation of the drive shaft 70 causes the feed roller 96 and the urge roller 100 to rotate in the direction of arrows "A" and thereby advance overlying sheets through the opening 16, that is, between the paper guides 36 and 38. The invention contemplates that the feed roller 96 and the urge roller 100 be driven at rate sufficient to yield a nominal roller surface speed of approximately 80 feet per minute. Roller speed can be changed to match the speed of downstream equipment. As a preferred material for the rollers 96 and 100, it is envisioned that the rollers have paper engaging surfaces of soft natural gum rubber to enhance the gripping force between the feed roller 96 and the urge roller 100 on the one hand and the bottom of a stack of sheets on the other. In addition, the exterior surface of the rollers 96 and 100 preferably has a medium to rough crepe finish achieved, for example, by roughening the surfaces with a grinding wheel. Rollers with the desired crepe surface may be obtained from Industrial Roller Co., 218 N. Main St., Smithton, Ill. 62285.

In some instances where high capacity is not of paramount concern, the feed roller 96 may be smooth natural gum rubber. In such a case, the periphery of the feed roller 96 is finished by grinding after the roller hub is assembled to the shaft 72. This assures excellent concentricity of the roller periphery about the axis of rotation of the shaft so that the position of the periphery of the roller 96 with respect to the retard roller remains within tight tolerances for good feeding.

Rotation of the retard roller 106 is prevented by frictional engagement of the roller 106 with a locking plate or brake 135 sandwiched between the retard roller 106 and the legs 123 of the mounting block 112. The locking plate 135 has a substantially planar body 138 with an opening 140 therein for receiving a reduced diameter of the shaft 124. The locking plate 135 includes four angled corners (prongs) 142 which are bent slightly out of the plane of the body 138 for engaging the side of the retard roller 106. An adjustment knob or hand wheel 144 is keyed to the shaft 124 for rotating the shaft 124 and thereby alternatively advancing a threaded end 143 of the shaft 124 into or withdrawing the shaft 124 from the threaded opening 129 in the leg 123. Advancement of the shaft end 143 into the opening 129 causes a shoulder 145 on the shaft 124 to bear against the locking plate 135 to force the plate 135 into frictional locking engagement with the retard roller 106. Withdrawal of the shaft end 143 from the opening 129 allows the locking plate 135 to back away from the roller 106 and thus relieves friction between the locking plate 135 and the retard roller 106 whereby the retard roller 106 can be manually rotated slightly to expose a new surface to the feed roller 96. The retard roller 106 then is again locked in place once rotated to a desired position. An anti-rotation opening 146 on the locking plate 135 receives the inner end of one of the fasteners 118 and in conjunction with a surface 200 prevents the locking plate 135 from rotating. The described construction of the friction lock for preventing rotation of the retard roller 106 permits the position of the retard roller 106 to be manually locked/changed without the use of tools by using only relatively light finger pressure.

Those skilled in the art will readily appreciate that the preferred urethane surface of the retard roller 106 has a harder surface than the preferred soft natural gum rubber, medium to rough crepe finish of the feed roller 96. It is preferred that the surface of the feed roller 96 be softer than that of the retard roller 106 positively avoid doubling.

Moreover, to achieve good control over the feeding of the paper without doubling, it is highly desirable that the position of the retard roller 106 be adjusted so that it at least touches the cylindrical periphery of the feed roller 96. Literally speaking, it is desirable that the retard roller 106 be adjusted toward the feed roller 96 so as to form slight depression in the feed roller 96 at the point of contact between the two. That is to say, the retard roller 106 should at least touch or be tangent to feed the roller 96, and more preferably, be such as to enter the normal cylindrical periphery as it would appear if the feed roller 96 were not deformed by the presence of the retard roller 106 at the point of contact.

While the precise position will vary depending upon a number of things including paper weight, pack height and the like, in general, proper adjustment can be had by placing a sheet in the nip with the machine in operation while manually restraining feeding of the sheet of paper. The nip may be made as tight as desired, so long as the sheet may be withdrawn from the nip from the input side while the feed roller 96 is rotating and without damaging the sheet.

When the sheet feeder 10 is to be utilized with a downstream form processing machine 146, such as a burster, copier, printer, or the like, the ratio of the angular rate of the feed roller 96 to the angular rate of the infeed rollers 148 in the downstream component 146 is prescribed in the range of from about 0.5 to about 1. Prescribing the speed ratio between the feed roller 96 and the downstream rollers 148 provides control over the amount of overlap between the trailing of a bottom sheet and the leading end of an adjacent sheet. When feeding 8.5×11 inch sheets, it has been found that a speed ratio of approximately 65% will correct up to about 1.5 inches of overlap of adjacent sheets.

The function of the gap 34 between the lip 44 on the movable cover 30 and the lip 60 on the stationary cover 32 is best shown in FIG. 11. As noted above, the size of the nip 108 and the corresponding frictional feed force achieved between the feed roller 96 and the retard roller 106 is manually selectable by rotating the adjustment knob 64. However, it is desirable that the nip 108 be substantially completely shielded by the cover assembly 20 when the sheet feeder 10 operates. The knob 64 extends outwardly of the cover 32 through the opening 62 so that the pressure feed force can be adjusted when the sheet feeder 10 operates.

In order to test the feed force of the feed roller/retard roller assembly when the knob 64 is adjusted, it is desirable to pull a sheet forwardly (that is, toward the infeed end of the sheet feeder 10) from the nip 108 when the sheet feeder 10 operates. Pulling a sheet forwardly from the nip 108 during operation provides a more accurate measure of feed force than a measurement of rearwardly withdrawal of a sheet from the nip 108.

The infeed opening 201 in the hopper 14 is spaced from the nip 108 a distance greater than that allowing manual withdrawal of a sheet from the nip 108. The gap 34 in the cover assembly 20 permits a sheet to be inserted into and withdrawn from the nip 108 while the feed roller 96 rotates without opening the cover. The slope of the lip 44 on the movable cover 30 and the lip 60 on the stationary cover 32 direct a sheet inserted therebetween toward the nip 108.

Figure 12:
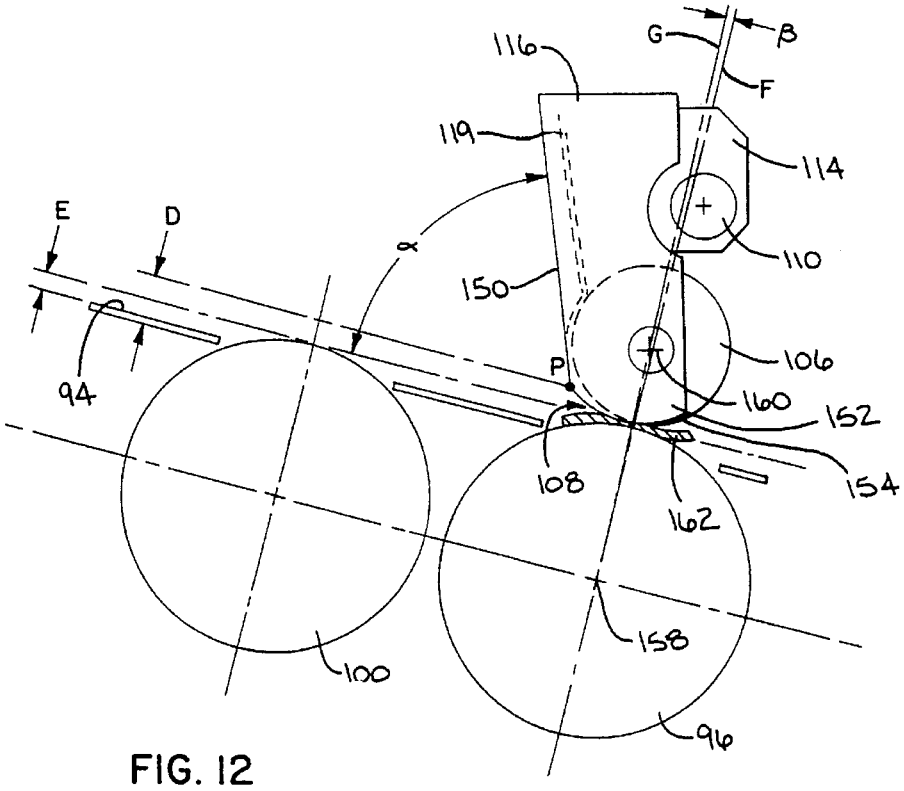
FIG. 12 is an enlarged fragmentary view showing the dimension relationship between the components of the roller arrangement.
Figure 13:
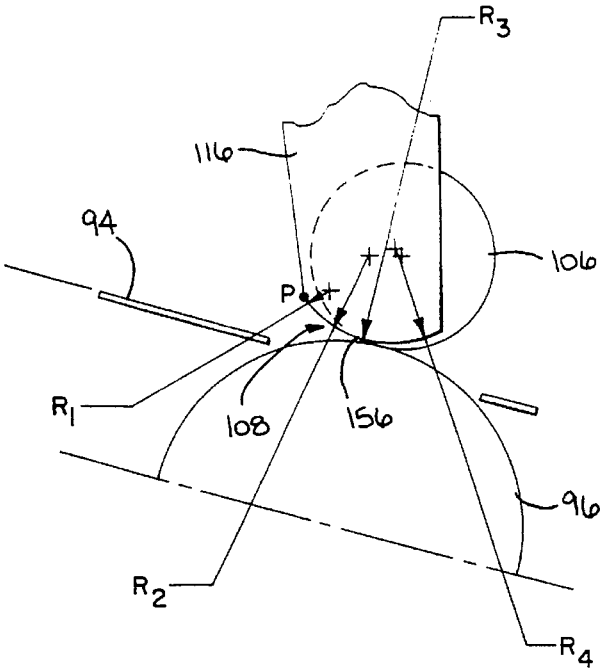
FIG. 13 is an enlarged fragmentary view showing a compound radius on a paper guide in the roller arrangement.

Also as shown in FIG. 11, the paper guide 119 and the infeed ends of the paper guides 116 engage the leading edge of sheets supported on the inclined surface 94 in the hopper 14 prior to feeding. Details of the paper guides 116 are illustrated in FIGS. 12–13.

The paper guides 116, 119 have a straight polished edge 150 which terminates at a curved lower end 152 for mounting the retard roller 106. The use of a polished edge reduces friction between the paper stack and the guides, allowing the stack to readily descend to the nip 108 during operation. Sheets stacked in the hopper 14 engage the polished edge 150 and smoothly slide downwardly along the guides 116, 119 as the supply of sheets in the stack gradually is depleted. In a preferred form of the invention, the edge 150 on each guide 116, 119 has a chrome plated surface.

The edge 150 of each paper guide 116, 119 is inclined at an acute angle α with respect to the feed surface 94 whereby sheets stacked thereon are not perpendicular to the edges 150. Rather, sheets supported on the feed surface 94 are inclined at the angle α with respect to the edge 150 of the guides 116, 119 so that individual sheets shift longitudinally relative to each other in order to maintain engagement of the leading edge of the sheets with the guide edge 150. Relative offset between adjacent sheets in the hopper 14 tends to break adhesion between adjacent sheets (which is especially evident when the forms are perforated for bursting) and thereby assures separation of the adjacent sheets and prevents doubled sheets from being fed into the nip 108. The invention envisions that the angle α be in the range of from about 60 degrees to about 80 degrees. In the preferred form of the invention, the angle α equals about 70 degrees.

The straight edge 150 on each paper guide 116 terminates at a point P spaced a distance D from the feed surface 94, at which point P an arcuate edge 154 on the paper guide lower end 152 is contiguous and tangentially integrated with the straight edge 150. The distance D preferably is in the range of about 0.4 to 0.6 inches, and in a preferred embodiment the distance D is about 0.5 inches.

The arcuate edge 154 consists of segments of individual arcs having radii R1, R2, R3 and R4 as shown in FIG. 13, which is to scale. The radius R1 preferably is in the range of about 0.15 to 0.35 inches, and in a preferred embodiment the radius R1 is approximately 0.25 inches. The radius R2 preferably is in the range of about 0.65 to 0.85 inches, and in a preferred embodiment the radius R2 is approximately 0.75 inches. The radius R3 preferably is in the range of about 1.8 to 2.2 inches, and in a preferred embodiment the radius R3 is approximately 2.0. The radius R4 preferably is in the range of about 0.75 to about 1 inch, and in a preferred embodiment the radius R4 is approximately 0.88 inches. The increasing radius of curvature of the arcuate edge 154 from the straight edge 150 into the nip 108 facilitates sliding of sheets along the guides 116 and feeding into the nip 108. The multiple radii of curvature of the arcuate edge 154 avoids a transition from the point of contact of the sheets from the height 116 to the retard roller 106 that is smooth but not particularly gradual, as would be the case if a single radius was used to define the curvature of the arcuate edge 154. If a too gradual transition is present, it permits the edge of paper sheets to engage the retard roller 106 well in advance of the nip, and that can result in those edges hanging up while the sheet continues to descend as subjacent sheets are fed. This, as mentioned in connection with the plate 119, can result in undesirable folding back parts of the leading edges of the sheet. The particular configuration of the arcuate edge 154 just described avoids this possibility.

The relationship between the curved lower ends 152 of the guides 116, 119 and the retard roller 106 provides an important function. When the bottom sheet of a stack of sheets is received in the nip 108 and fed through the opening 16, the overlying sheets slide down along the straight edge 150 and along the curved edge 152 of the guides 116, 119. The disclosed curvature of the arcuate edge 152 tends to shift sheets longitudinally relative to each other even more than when the sheets are fanned against the straight edge 150. Moreover, as the sheets drop down along the guides 116, 119, the bottommost sheet first engages a slightly protruding exposed edge 156 (FIG. 13) of the retard roller 106 before being smoothly urged into the nip 108. Contact between the overlying sheets and the exposed portion of the retard roller 106 prevents the sheets from entering the nip 108 when the bottom sheet is being fed.

Still another feature aimed at facilitating the rapid feeding of single sheets from the bottom of a stack of sheets is the relationship between the positions of the center 158 of the feed roller 96 and the center 160 of the retard roller 106 relative to the line of action of the feeding force produced by the rollers.

More particularly, and referring to the geometric construction illustrated in FIG. 12, a line "F" connects the centers 158 and 160 of the rollers 96 and 106, respectively. A line "G" is perpendicular to the feed surface 94 and contains the center 158 of the feed roller 96. The retard roller 106 has a top dead center (TDC) position defined as that position whereat the center 160 of the retard roller 106 would lie on the line "G". By positioning the retard roller 106 so that the line "F" is inclined at an angle β relative to the line "G", the center 160 of the retard roller 106 is sufficiently offset from the top dead center position that a sheet 162 received in the nip 108 undergoes a generally S-shaped deflection as the sheet 106 is fed. The S-deflection is believed to assist in keeping paper which may be highly curled after printing, such as laser printing, in the correct travel path. Operation is achieved in the range from about 5° before TDC to 2° past TDC, with the optimal geometry being defined by how the downstream paper path is configured, i.e. the nature of additional equipment located downstream of the feeder. For one embodiment, a location of 0° 30' plus or minus 0° 30' past TDC is employed, thereby defining a 0° to 1° past TDC offset.

The relative sizes of the rollers 96, 100 and 106 are selected to optimally feed sheets having a width of approximately 8.5 inches and a length of approximately 11 inches. Specifically, the feed roller 96 and the urge roller 100 have a diameter in the range of from about 2.5 inches to about 5 inches, and preferably have a diameter of about 3.5 inches. Roller width is in the range of about 0.375 to about 1.875 inches. A roller width of 0.700 is preferred. The diameter and width of the rollers 96 and 100 is selected to increase contact area with the overlying sheets to produce a friction force sufficient to advance the sheets while at the same time minimize the effects of abrasive wear and degradation of the roller surface.

Release of a bottom sheet from the feed surface 94 also is facilitated because the rollers 96 and 100 extend partially through the openings 98 and 102, respectively, and lift a portion of a bottom sheet to decrease the surface area of the sheet which is engaged by the feed surface 94. The rollers 96 and 100 penetrate through the feed surface 94 a distance E. The distance E preferably is in the range of about 0.1 to 0.3 inches, and in a preferred embodiment the distance E is about 0.2 inches. If the sheet feeder is used for sheets shorter than 11", it is desirable to have the distance E reduced, for longer sheets the distance E should be increased. Ranges for the distance E from 0 inches to 0.6 inches have been found advantageous.

In addition to the distance which rollers 96 and 100 lift a sheet above the feed surface 94, the distance between the centers of the rollers 96 and 100 also has been found to affect the release of sheets from the surface 94. More specifically, for an 8.5×11 inch sheet, it has been determined that a spacing in the range of from about 3.5 inches to about 4 inches between the center of the roller 96 and the center of the roller 100 yields optimal feed results, with a preferred form of the invention having a separation between the respective centers of the rollers 96 and 100 of about 3.7 inches.

If the machine is not properly adjusted and "doubles" are being fed, means may be provided to halt the occurrence. Specifically, a photoelectric through beam scanner 210 will detect the condition and stop the sheet feeder 10. The scanner 210 has a light source 212 which shines a visible, red, light beam from one side of the sheet through the fed sheet. A detector 214 determines an intensity of the light received on the other side of the sheet. The intensity depends on the intensity of the light beam source 212 and the thickness of the sheet. If two or more sheets are fed simultaneously the received intensity of light is diminished which triggers the detector 214 to stop the sheet feeder 10 by means of a conventional shut off circuit 216. The intensity of the light beam source 212 can be varied by the operator to adjust for different weight and color sheets. Banner Photoelectrics of Minneapolis Minn. is a manufacturer of photoelectric through beam scanners.

The foregoing construction of a sheet feeder reveals features which contribute to unparalleled performance over prior sheet feeding devices. Namely, the present invention is uniquely adapted to reliably feed single sheets from the bottom of stacks containing one thousand up to as many as five thousand or more 8.5×11 inch sheets at rates in excess of several hundred sheets per minute. It must also be appreciated that by using the principles of the invention, one may vary the dimensional relationships taught hereinabove to achieve desirable performance advantages when the sheet feeder is to be utilized with other sheets sizes.

We claim:

1. A sheet feeder for feeding sheets from the bottom of a stack thereof, comprising:

a frame having an inclined surface for supporting a stack of sheets to be fed;

a relatively soft feed roller mounted on the frame;

means for rotating the feed roller;

a stationary relatively hard retard roller mounted adjacent to and at least touching said feed roller and cooperating therewith to define a nip for receiving a forward edge of a bottom sheet of a stack supported on said inclined surface; and an upright guide on the frame engageable with a forward edge of a stack of sheets supported on the inclined surface, the guide being disposed at an acute angle with respect to the inclined surface so that when the forward edge of the stack engages the guide the sheets shift longitudinally relative to each other to facilitate feeding of a single sheet into the nip.

2. The sheet feeder of claim 1 in which the guide is disposed at an angle relative to the inclined surface in the range of from about 60 degrees to about 80 degrees.

3. The sheet feeder of claim 1 in which the guide has a polished surface for engaging the forward edge of a stack of sheets.

4. The sheet feeder of claim 1 in which the guide has a chrome plated surface for engaging the forward edge of a stack of sheets.

5. The sheet feeder of claim 1 in which the retard roller has an exposed surface which extends beyond the guide whereby the forward edge of a bottom one of the sheets in said stack contacts the exposed surface before being received in the nip.

6. The sheet feeder of claim 1 in which the guide has a straight upper end and a curved lower end so that sheets engaged with said bottom end shift relative to each other a distance greater than the sheets engaged with said upper end.

7. The sheet feeder of claim 6 wherein said curved lower end has an arcuate edge and said upper end has a substantially straight edge contiguous with said arcuate edge, said arcuate edge being defined by a plurality of adjacent arcs having different radii of curvature.

8. The sheet feeder of claim 7 in which the radius of curvature of said arcuate edge increases along said arcuate edge from said straight edge into the nip.

9. The sheet feeder of claim 1 in which a top dead center position of the retard roller is defined as that position of the retard roller whereat a first line connecting the center of the retard roller and the center of the feed roller would be perpendicular to said inclined surface, the center of the retard roller being offset from said top dead center position to facilitate paper control of a single sheet out of the nip.

10. The sheet feeder of claim 9 in which the retard roller is positioned so that a second line connecting the center of the retard roller and the center of the feed roller is inclined at an angle relative to said first line in the range of from about 0 degrees to about 1 degree.

11. The sheet feeder of claim 1 having an urge roller engageable with a bottom sheet on the stack for advancing said sheet toward the feed roller, said urge roller and said feed roller having diameters which are substantially equal.

12. The sheet feeder of claim 11 in which the urge roller has a rubber surface.

13. The sheet feeder of claim 1 in which the retard roller has a urethane surface having a durometer in the range of from about 50 to about 70 on the Shore A scale of relative hardness.

14. The sheet feeder of claim 1 in which the feed roller has a rubber surface.

15. The sheet feeder of claim 1 wherein the feed roller has a natural rubber medium to rough crepe finish.

16. The sheet feeder of claim 1 to be used in conjunction with a downstream component for receiving sheets fed by the sheet feeder, said component having a roller rotated at a second rate for drawing sheets from the sheet feeder, the ratio of the rate of rotation of the feed roller to the rate of rotation of a downstream roller being in the range of from about 0.5 to about 1.

17. The sheet feeder of claim 1 further including a means for detecting if more than a single sheet has been fed and stopping said sheet feeder if more than a single sheet is detected.

18. The sheet feeder of claim 17 wherein said detecting means is a photoelectric through beam scanner, said scanner having a light source and a detector, said light source being on one side of a sheet and directed through the sheet as it is fed out of said nip and the detector on the other side of the sheet detects an intensity of the light passing through the sheet.

19. A sheet feeder for feeding sheets from the bottom of a stack thereof, comprising:

a frame having an inclined surface for supporting a stack of sheets to be fed;

a relatively soft feed roller mounted on the frame;

means for rotating the feed roller;

a stationary relatively hard retard roller mounted adjacent to and at least touching said feed roller and cooperating therewith to define a nip for receiving a forward edge of a bottom sheet of a stack supported on said inclined surface; and an upright guide on the frame engageable with a forward edge of a stack of sheets supported on the inclined surface, the guide being disposed at an acute angle with respect to the inclined surface so that when the forward edge of the stack engages the guide the sheets shift longitudinally relative to each other to facilitate feeding of a single sheet into the nip;

said retard roller being mounted on a shaft, and including a plate movable along the shaft and friction lock means for holding the plate in frictional engagement with the retard roller to prevent the retard roller from rotating when the feed roller rotates.

20. The sheet feeder of claim 19 wherein said friction lock means comprises a shoulder on the shaft engageable with the plate and adjustable toward and away from the retard roller, and an adjustment handle for said shaft.

21. The sheet feeder of claim 20 in which the shaft has a threaded end engaged with the frame whereby rotation of the shaft causes the shoulder to move toward and away from the retard roller, and including anti-rotation means on the plate for preventing the plate from rotating when the shaft is rotated.

22. A sheet feeder operable to feed single sheets from the bottom of a stack of one thousand sheets or more, said sheets being generally rectangular and having a width of approximately 8.5 inches and a length of approximately 11 inches, the sheet feeder comprising:

a frame having an inclined surface for supporting a stack of sheets to be fed;

a feed roller mounted on the frame, said feed roller having a diameter in the range of from about 2.5 inches to about 5 inches;

a stationary retard roller mounted in overlying, at least touching relation with said feed roller and defining a nip between the feed roller and the retard roller for receiving a forward edge of a bottom one of the sheets in said stack, said retard roller having a diameter in the range of from about 0.75 inch to about 3 inches; and an urge roller engageable with a bottom sheet on the stack for advancing said sheet toward the feed roller, said urge roller and said feed roller having diameters which are substantially equal.

23. The sheet feeder of claim 22 in which the center of the feed roller and the center of the urge roller are spaced apart from each other a distance in the range of from about 3.5 inches to about 4 inches.

24. The sheet feeder of claim 23 in which at least one of the feed roller and the urge roller has a width in the range of from about 0.375 inches to about 1.875 inches.

25. The sheet feeder of claim 22 in which at least one of the feed roller and the urge roller partially extend through the inclined surface and lift the bottom sheet of the stack therefrom, said one roller extending a distance in the range of from about 0.0 inches to about 0.6 inches.

26. The sheet feeder of claim 22 including a cover assembly for substantially enclosing the nip when the sheet feeder operates, and adjustment means extending outwardly of the cover assembly for selectively moving the retard roller toward and away from the feed roller to adjust the size of the nip and vary a friction force for feeding a single sheet through the nip.

27. The sheet feeder of claim 22 including a cover assembly for substantially enclosing the nip when the sheet feeder operates, and friction feed testing means on the cover for permitting insertion of a single sheet into and withdrawal of a single sheet from the nip when the sheet feeder operates.

28. The sheet feeder of claim 27 in which the friction feed testing means comprises a narrow opening in the cover assembly above the nip.

29. The sheet feeder of claim 28 in which the opening has a sloped lip for directing a single sheet toward the nip.

30. A sheet feeder operable to feed single sheets from the bottom of a stack of one thousand sheets, said sheets being generally rectangular, the sheet feeder comprising:

a frame having an inclined surface for supporting a stack of sheets to be fed;

a feed roller mounted on the frame;

a retard roller mounted in overlying, at least touching relation with said feed roller and defining a nip between the feed roller and the retard roller for receiving a forward edge of a bottom one of the sheets in said stack; and a cover assembly for substantially enclosing the nip when the sheet feeder operates, said cover assembly having friction feed testing means for permitting insertion of a single sheet into and withdrawal of a single sheet from the nip when the sheet feeder operates.

31. The sheet feeder of claim 30 including adjustment means extending outwardly of the cover assembly for selectively moving the retard roller toward and away from the feed roller to adjust the size of the nip and vary a friction force for feeding a single sheet through the nip.

32. The sheet feeder of claim 30 wherein said friction feed testing means comprises a narrow opening in the cover assembly sufficiently proximate to said nip to permit insertion of a single sheet into and withdrawal of a single sheet from the nip when the sheet feeder operates.

33. The sheet feeder of claim 32 in which the opening has a sloped lip for directing a single sheet toward the nip.

34. The sheet feeder of claim 32 wherein said second hand wheel is on said shaft so that said shaft may be manually rotated, and said shaft further includes a shoulder bearing against said brake.

35. In a sheet feeder for feeding sheets from the bottom of a stack, the combination of a frame including a sheet supporting surface;

an opening in said surface;

a driven feed roller mounted on said frame below said surface and having a portion of its periphery extending through said opening;

a retard roller mounted on said frame in overlying relation to said feed roller and defining a nip therewith;

said retard roller being mounted on a shaft;

means mounting said shaft for movement toward and away from said feed roller and including a first hand wheel for selectively moving said shaft toward and away from said feed roller;

a brake for locking said retard roller against rotation on said shaft; and means including a second hand wheel for actuating or releasing said brake.

36. A sheet feeder for feeding sheets from the bottom of a stack thereof, comprising:

a frame having an inclined surface for supporting a stack of sheets to be fed;

a relatively soft feed roller mounted on the frame;

means for rotating the feed roller;

means defining a stationary, relatively hard, arcuate surface adjacent to and at least touching said feed roller and cooperating therewith to define a nip for receiving a forward edge of a bottom sheet of a stack supported on said inclined surface;

an upright guide on the frame engageable with a forward edge of a stack of sheets supported on the inclined surface and including means whereby when the forward edge of the stack engages the guide, the sheets shift longitudinally relative to each other to facilitate feeding of a single sheet into the nip.

* * * * *